US007855358B2

(12) United States Patent
Schleifer et al.

(10) Patent No.: US 7,855,358 B2
(45) Date of Patent: Dec. 21, 2010

(54) METHOD AND AN ION SOURCE FOR OBTAINING IONS OF AN ANALYTE

(75) Inventors: Arthur Schleifer, Portola Valley, CA (US); Steven Michael Fischer, Hayward, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 360 days.

(21) Appl. No.: 11/963,843

(22) Filed: Dec. 23, 2007

(65) Prior Publication Data

US 2009/0159794 A1 Jun. 25, 2009

(51) Int. Cl.
*H01J 49/00* (2006.01)

(52) U.S. Cl. ..... 250/288; 250/281; 250/282; 250/425; 250/423 R; 250/424; 204/157.2; 204/157.22

(58) Field of Classification Search ..... 250/281, 250/282, 288, 423 R, 424, 425; 204/157.2, 204/157.22

See application file for complete search history.

(56) References Cited

U.S. PATENT DOCUMENTS

| | | | | |
|---|---|---|---|---|
| 5,110,430 | A * | 5/1992 | Eerkens | 204/157.2 |
| 6,949,742 | B1 | 9/2005 | Figueroa | |
| 7,078,681 | B2 | 7/2006 | Fischer et al. | |
| 2005/0035285 | A1 * | 2/2005 | Tan et al. | 250/288 |

* cited by examiner

*Primary Examiner*—Jack I Berman
*Assistant Examiner*—Hanway Chang

(57) ABSTRACT

A method of obtaining ions of an analyte is disclosed. The method includes aerosolizing a sample using a thermal liquid jetting device or a piezoelectric liquid jetting device to obtain an aerosol without ionizing the sample. The sample includes the analyte in a solvent. The method further includes drying the aerosol to obtain gas phase solvent and gas phase analyte, and ionizing the gas phase analyte to obtain ions thereof. An ion source using the method for obtaining ions of an analyte is also disclosed.

19 Claims, 4 Drawing Sheets

METHOD AND AN ION SOURCE FOR OBTAINING IONS OF AN ANALYTE

BACKGROUND

Electrospray is a method of generating a very fine liquid aerosol through electrostatic charging. Electrospray, as the name implies, uses electricity to form small droplets. In electrospray, a plume of droplets is generated by electrically charging a liquid passing through a nozzle to a very high voltage. The charged liquid in the nozzle is forced to hold more and more charge until the liquid reaches a critical point at which it ruptures into a cloud of tiny, highly charged droplets.

Electrospray is referred to as "electrospray ionization" (ESI) when used as an ionization method for chemical analysis. ESI is the process of generating a gas phase ion from a typically dissolved solid or liquid chemical species. The electrospray process allows the structural analysis of unlimited molecular weight, e.g., large biomolecules, in the field of mass spectrometry and is directly compatible with liquid chromatography methods. Ionization is an important event in mass spectrometry by allowing accurate mass to charge ratio measurements of ions. A mass spectrometer is an instrument which can measure the masses and relative concentrations of atoms and molecules by evaluating a number of forces on a moving charged particle. Once an ion's mass is ascertained, this information can be used to determine its chemical composition.

U.S. Pat. No. 6,949,742, Figueroa, entitled "Method and A System for Producing Electrospray Ions" discloses a number of prior art electrospray configurations. FIG. 1 illustrates one such prior art electrospray configuration. The electrospray ion source 2 configuration includes a gas source 4 such as compressed nitrogen and a sample material source 6 being fed directly to a plurality of platinum concentric needles 8. The gas source 4 forces a constant quantity per unit time of the sample material through the platinum concentric needles 8 producing a continuous flow of sample spray or aerosol 10. A potential is then generated on a counter electrode 12 by a power supply 14 on the aerosol 10 causing a continuous flow of electrospray ions 16 to be directed to a number of Einzel/ion lenses 18 and subsequently to a mass analyzer 20.

This configuration suffers a number of disadvantages. The use of electrostatics on the aerosol to obtain ions is effective only for solvents and solvent mixtures having certain properties. It may not be as effective when used on solvents and solvent mixtures having other properties. The aerosol 10 formed is also not focused at an inlet of the mass analyzer 20 but tends to cover a wide area around the inlet. This spread of the aerosol results in the mass analyzer 20 receiving only a portion of the charged ions in an area immediately adjacent the inlet. Consequently, the aerosol 10 is not evenly sampled and may result in limited sensitivity of the mass spectrometer. This spread of the aerosol 10 may also result in differences in the rate at which charged ions from different areas of the aerosol arrive at the inlet, which may lead to band broadening.

FIG. 2 illustrates the components of a prior art thermal inkjet (TIJ) electrospray ion source 30 disclosed in the patent for solving the abovementioned problems. The thermal inkjet electrospray ion source 30 includes a sample source 6 or sample reservoir fluidly coupled to a thermal inkjet material dispenser 32. Additionally, a computing device 34 may be communicatively coupled to the thermal inkjet material dispenser 32 according to one exemplary embodiment. An electrically conducting grid 34 is disposed adjacent to the thermal inkjet material dispenser 32 in the path of the nozzles of the thermal inkjet material dispenser 32. A counter electrode 12 coupled to a plurality of Einzel/ion lenses 18 that lead to a time-of-flight mass analyzer 36 are disposed opposite the electrically conducting grid 34. Both the electrically conducting grid 34 and the counter electrode 12 are electrically coupled to a power supply 14 configured to independently vary the voltage at the electrically conducting grid 34 and the counter electrode 12. As can be seen in FIG. 2, the thermal inkjet electrospray ion source 30 allows for a linear configuration while providing a pulsed material sample to the mass analyzer 36.

The thermal inkjet electrospray ion source 30 illustrated in FIG. 2 is configured to generate small droplets of a sample material using the thermal inkjet material dispenser 32. These generated droplets of sample material then react to a potential generated between the conducting grid 34 and the counter electrode 12. In response to the generated potential, the droplets of sample material are accelerated towards the Einzel/ion lenses 18 and the mass analyzer 36. During this acceleration, an electrospray process occurs and the charged ions of the sample material are formed. In further detail, the electrospray process begins with an accumulation of positively charged ions in the small droplets of sample material, causing surface instability. When the Coulombic repulsions, or the repulsion among similarly-charged regions of a particle, between the positively charged ions exceed the surface tension of the sample material, smaller droplets will start to come off the surface of the liquid, forming a mist. As these droplets travel towards the counter electrode 12, a solvent portion of the sample material evaporates causing the droplets to shrink and, as a consequence, the distance between positive charges at the surface of the droplets become smaller and charge repulsion gets stronger. This process continues until the Coulombic repulsions are stronger than the surface tension of the droplet (a condition called the Rayleigh instability limit) causing the droplet to explode into smaller charged droplets of analyte molecules ready to be analyzed in the mass analyzer 36.

Although this thermal inkjet electrospray ion source overcomes some of the abovementioned disadvantages associated with the electrospray ion source in FIG. 1, there remain disadvantages associated with the above described ESI techniques where the aerosol is subjected to a generated electric potential such that charge is transferred to the analyte via the solvent. In other words, the solvent is charged in order to charge the analyte. The mass analyzer can receive only a certain amount of charged ions. However at an inlet of the mass analyzer, not all solvent is evaporated. Both analyte and solvent ions are thus received by the mass analyzer. With the receiving of both the charged solvent ions and the charged analyte ions, the sensitivity of the mass analyzer may be reduced. Furthermore, the charged solvent ions may also interact with the charged analyte ions to result in ion suppression and unreliable quantization. The dynamic range of the mass analyzer is limited by the amount of charge that can be placed on the liquid. Moreover, the ESI technique will not ionize all compounds. ESI discriminates against very nonpolar molecules. ESI is also susceptible to adduct formation that complicates spectral interpretation and creates non-linearities when trying to generate a linear calibration curve. It would thus be desirable to have an ion source that overcomes at least one of the above remaining disadvantages.

BRIEF DESCRIPTION OF DRAWINGS

The invention will be better understood with reference to the drawings, in which.

DETAILED DESCRIPTION OF THE EMBODIMENTS

Figure 1:
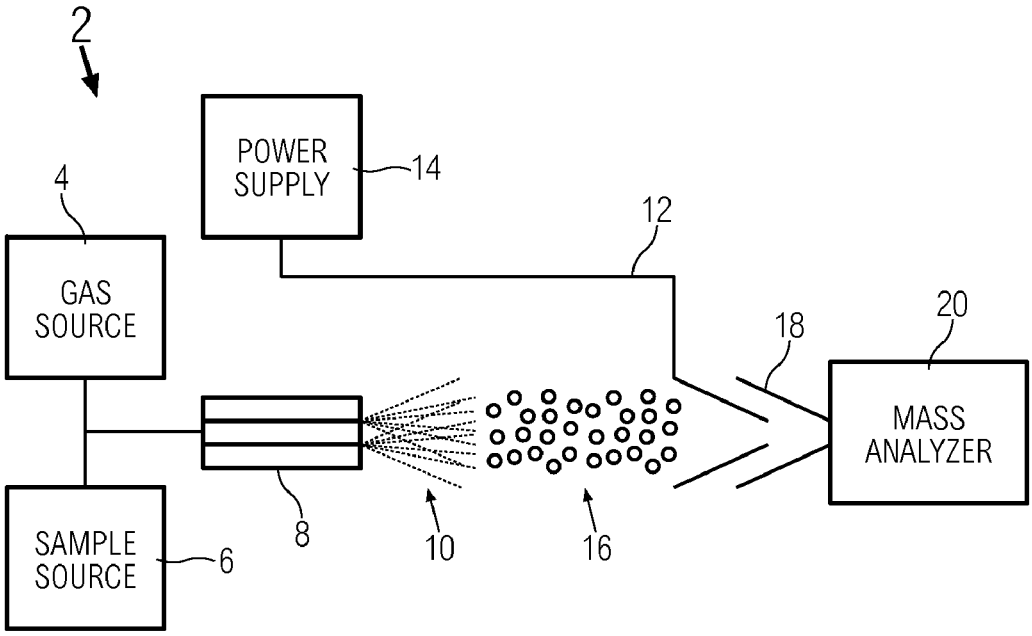
FIG. 1 (PRIOR ART)
FIG. 1 is a simple block diagram illustrating a prior art electrospray configuration.
Figure 2:
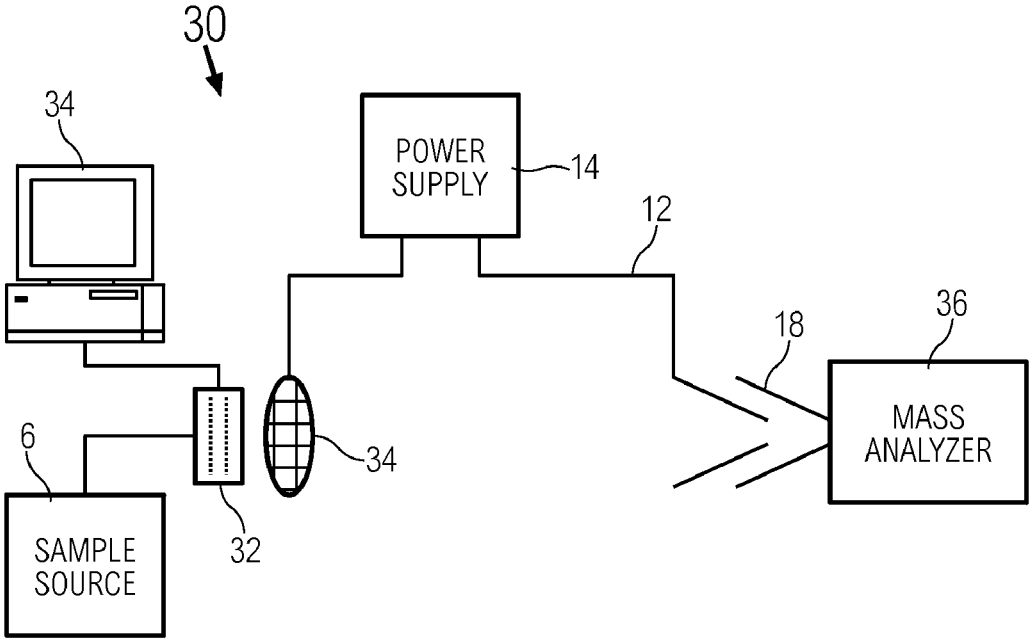
FIG. 2 (PRIOR ART)
FIG. 2 is a simple block diagram illustrating the components of another prior art electrospray configuration including a thermal inkjet material dispenser.
Figure 3:
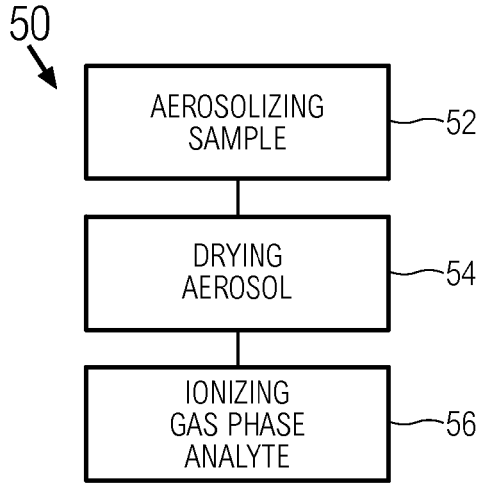
FIG. 3 is a flow chart showing a sequence of steps for obtaining ions of an analyte according to an embodiment of the invention.

As shown in FIG. 3, the invention may be embodied in a method of obtaining ions of an analyte dissolved in a solvent for use in a mass spectrometer. Existing methods of obtaining ions include obtaining a substantial amount of ions of the solvent which compete with the analyte ions to be received by a mass analyzer of the mass spectrometer, thereby limiting the sensitivity of the mass spectrometer. The method of obtaining ions generally includes aerosolizing a sample using a thermal or piezoelectric liquid jetting device to obtain an aerosol without ionizing the sample, wherein the sample includes the analyte in the solvent. The method further includes drying the aerosol to obtain gas phase solvent and gas phase analyte, and ionizing the gas phase analyte to obtain ions thereof. With the substantial ionization of the gas phase analyte, there is less competition of charged ions for entry into the mass analyzer.

The method is described in more detail with the aid of FIG. 3 which shows a sequence 50 of steps in an ion source for obtaining analyte ions. The sequence 50 starts in an AEROSOLIZING SAMPLE step 52, wherein a sample, for example from a liquid chromatography system, is aerosolized to produce an aerosol. The sample includes an analyte dissolved in a solvent. The sample is aerosolized without ionizing the sample. A thermal liquid jetting device or a piezoelectric liquid jetting device is used to produce the aerosol. The liquid jetting devices may be similar to inkjet printheads that are able to eject drops of drop volumes in the range of 1 to 20 picoliters. A 1 picoliter drop is approximately 12 microns in diameter and a 20 picoliter drop is approximately 34 microns in diameter. The frequency of ejecting the sample from a single orifice of a liquid jetting device may be adjusted according to the flow rate of the sample into the spraying device. If the maximum frequency of the jetting device cannot cater to the flow rate, the sample may be ejected from more than one orifice.

The sequence 50 next proceeds to a DRYING AEROSOL step 54, wherein the aerosol is dried to obtain gas phase solvent and gas phase analyte. Drying of the aerosol may include drying the aerosol in a drying tube. Alternatively, the drying tube may be a drying tube that is heated to aid in the drying of the aerosol. After drying of the aerosol, the sequence 50 next proceeds to an IONIZING GAS PHASE ANALYTE step 56, wherein the gas phase analyte is ionized. The gas phase analyte may be ionized for example by irradiating the gas phase analyte with light from a light source or any other suitable means. The light source includes but is not limited to a Krypton, an Argon, a Helium light source. The wavelength of the light is usually selected such that the light ionizes at least substantially the gas phase analyte without substantially ionizing the gas phase solvent. In other words, the gas phase analyte has a lower ionization potential than the ionization potential of the gas phase solvent so that the light only ionizes the gas phase analyte without substantially ionizing the gas phase solvent. The ionizing of the gas phase analyte may be carried out at atmospheric and non-atmospheric pressure. In other embodiments, the light source is chosen such that the light ionizes the gas phase solvent. The ionized gas phase solvent may undergo charge exchanges and ionize the analyte. Optionally, the sequence may further include a GUIDING AEROSOL step (not shown), wherein the aerosol that is produced is guided in a desired direction by the flow of a carrier gas, for example towards the inlet of a mass analyzer.

Figure 4:
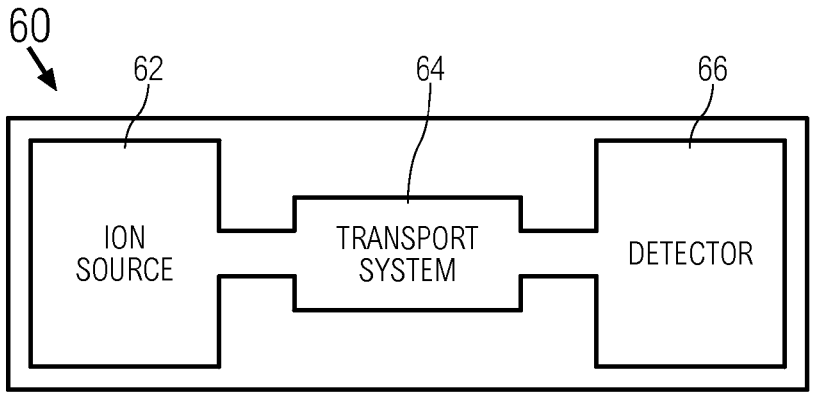
FIG. 4 is a block diagram illustrating the components of a mass spectrometer according to another embodiment of the invention.

FIG. 4 shows a block diagram of a mass spectrometer 60 according to another embodiment of the invention wherein the abovementioned sequence 50 is implementable. The block diagram is drawn in a general format because the invention may be used with a variety of different types of mass spectrometers. The mass spectrometer 60 includes an ion source 62, a transport system 64 and a detector 66. The ion source 62 will be described in more detail shortly. The transport system 64 may include a conduit such as a sleeve, transport device, dispenser, capillary, nozzle, hose, pipe, pipette, port, connector, tube, orifice, orifice in a wall, coupling, container, housing, structure or any apparatus for transporting ions from the ion source 62 to the detector 66. In certain embodiments, the conduit may simply be an orifice (not shown) through which the ions flow. The detector 66 may include a mass analyzer or other similar device well known in the art for detecting the analyte ions that were collected and transported by the transport system 64. The detector 66 may also include any computer hardware and software that are well known in the art which may help in detecting analyte ions.

Figure 5:
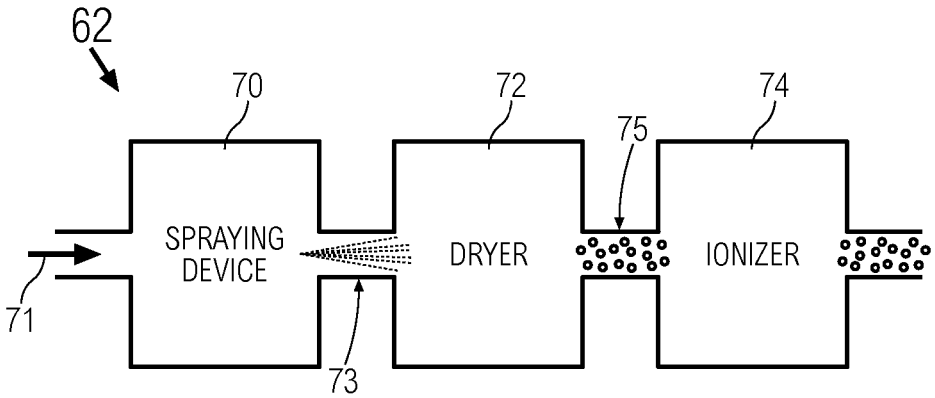
FIG. 5 is a block diagram of an ion source according to yet another embodiment of the invention that is a part of the mass spectrometer in FIG. 4.

FIG. 5 shows a block diagram of the ion source 62 in FIG. 4. The ion source 62 includes a spraying device 70 that aerosolizes a sample 71 from a liquid chromatography system (not shown) to obtain an aerosol 73 without ionizing the sample 73. The ion source 62 further includes a dryer 72 that dries the aerosol 73 to obtain gas phase solvent and gas phase analyte 75 and an ionizer 74 that ionizes the gas phase analyte 75 to obtain analyte ions that is drawn into the transport system 64 for transfer to the detector 66.

Figure 6:
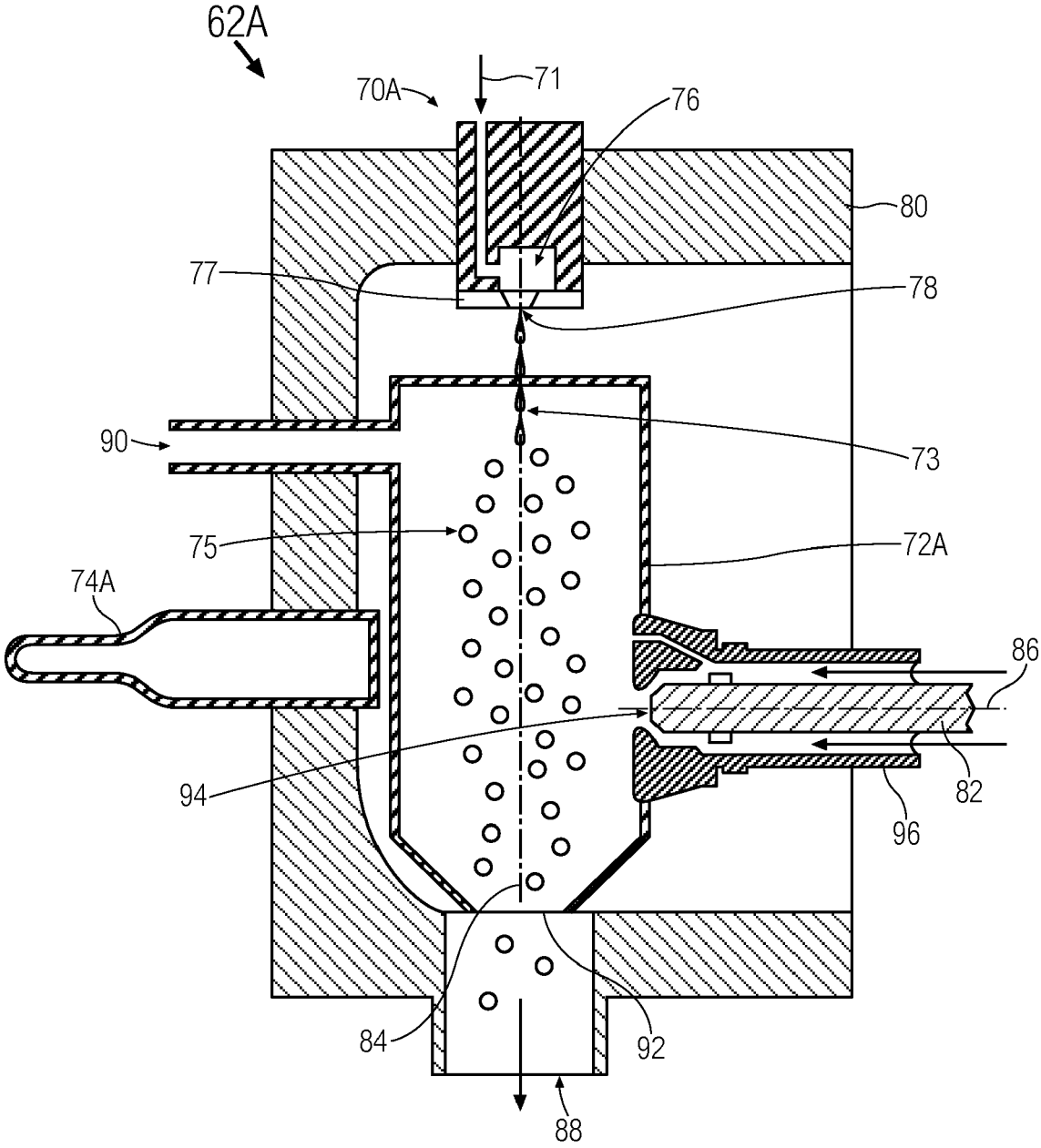
FIG. 6 is a cross-sectional view of an ion source according to one embodiment of the invention.

A first ion source 62A according to one embodiment of the invention is next described with the aid of FIG. 6. The first ion source 62A includes a thermal liquid jetting device 70A as a spraying device 70 that provides droplets in an aerosol form 73. An example of a thermal liquid jetting device 70A is one that is used in inkjet printers having a firing chamber 76 flanked on one side by an orifice plate 77 having at least one orifice 78. The spraying device 70 may alternatively be a piezoelectric liquid jetting device, such as a piezoelectric print head used in inkjet printers. The thermal liquid jetting device 70A may be located in a number of positions, orientations or locations within a housing 80 of the ion source 62A. The figure shows the thermal liquid jetting device 70A in an orthogonal arrangement to a conduit 82 (shown as a capillary) of the transport system 64. In other words, the thermal liquid jetting device 70A has a "molecular longitudinal axis" 84 that is perpendicular to the conduit longitudinal axis 86 of the conduit 82. The term "molecular longitudinal axis" refers to the theoretical axis or line that can be drawn through the region having the greatest concentration of molecules in the direction of spray or ejection from the thermal liquid jetting device 70A. In addition, although the figures show the invention in a substantially orthogonal arrangement (molecular longitudinal axis 84 is essentially orthogonal to longitudinal axis 86 of the conduit 82), this is not required. A variety of angles (obtuse and acute) may be defined between the molecular longitudinal axis 84 and the longitudinal axis 86 of the conduit 82. Alternatively, the molecular longitudinal axis 84 may be aligned with the longitudinal axis 86 of the conduit 82. That is, the molecular longitudinal axis 84 and the longitudinal axis 86 of the conduit 82 form a substantially straight line. The pressure in the housing 80 is maintained at about 20 to about 2000 Torr. Operation at atmospheric pressure (around 760 Torr) and non-atmospheric pressure is thus possible. The housing 80 has an exhaust port 88 for removal of gases.

The dryer 72 in the first ion source 62A is a drying tube 72A. The drying tube 72A may be a separate component or may be integrated with the housing 80. The drying tube 72A is positioned adjacent to the orifice 78 of the thermal liquid jetting device 70A for receiving and drying the aerosol 73 that is produced by the thermal liquid jetting device 70A. The drying tube 72A may be heated by a heater (not shown). The heater may include, but is not limited to, an infrared (IR) lamp or emitter, a heated surface, a turbo spray device, and a microwave lamp. Alternatively or additionally, the drying tube 72A may be heated by flowing a hot inert carrier gas 90 through the drying tube 72A. Such a carrier gas 90 when flowed through the drying tube 72A also serves to guide or direct the aerosol 73 towards an outlet 92 of the drying tube 72A. The drying tube 72A turns the aerosol droplets 73 into gas phase solvent and gas phase analyte 75. The amount of heat required to dry the solvent may be calculated based on the drop volume of the thermal liquid jetting device 70A and the solvent composition. Unlike in the prior art, the gas phase solvent is substantially without any charge since the aerosol 73 is not affirmatively subjected to any electric potential.

A light source 74A, such as at least one ultraviolet (UV) lamp, is used as the ionizer 70 that is capable of ionizing molecules. The light source 74A may also include, but is not limited to, a Krypton, an Argon, a Helium light source. The light source 74A may be positioned in a number of locations downstream from the thermal liquid jetting device 70A adjacent a portion of the drying tube 72A where the aerosol is dried sufficiently to turn into the gas phase solvent and gas phase analyte 75. This portion of the drying tube defines an ionization region of the drying tube 72A. The wavelength of the light source 74A is selected such that it at least substantially ionizes the gas phase analyte without substantially ionizing the gas phase solvent to produce analyte ions. In other words, ideally, only the gas phase analyte is ionized while the gas phase solvent is not ionized at all. However, it is possible that some gas phase solvent may be ionized.

The transport system 64 (shown generally in FIG. 4) may include the conduit 82 or any number of capillaries, conduits or devices for receiving and moving the analyte ions from the ionization region to the detector 66. The conduit 82 is disposed in the housing 80 downstream from the thermal liquid jetting device 70A opposite to the light source 74A. The conduit 82 has an orifice 94 that receives the analyte ions and transports them to the detector 66. Optionally, a gas conduit 96 may provide a drying gas toward the ions in the ionization region. This drying gas interacts with the analyte ions in the ionization region to remove any remaining solvent from the aerosol 73 provided from the thermal liquid jetting device 70A.

Figure 7:
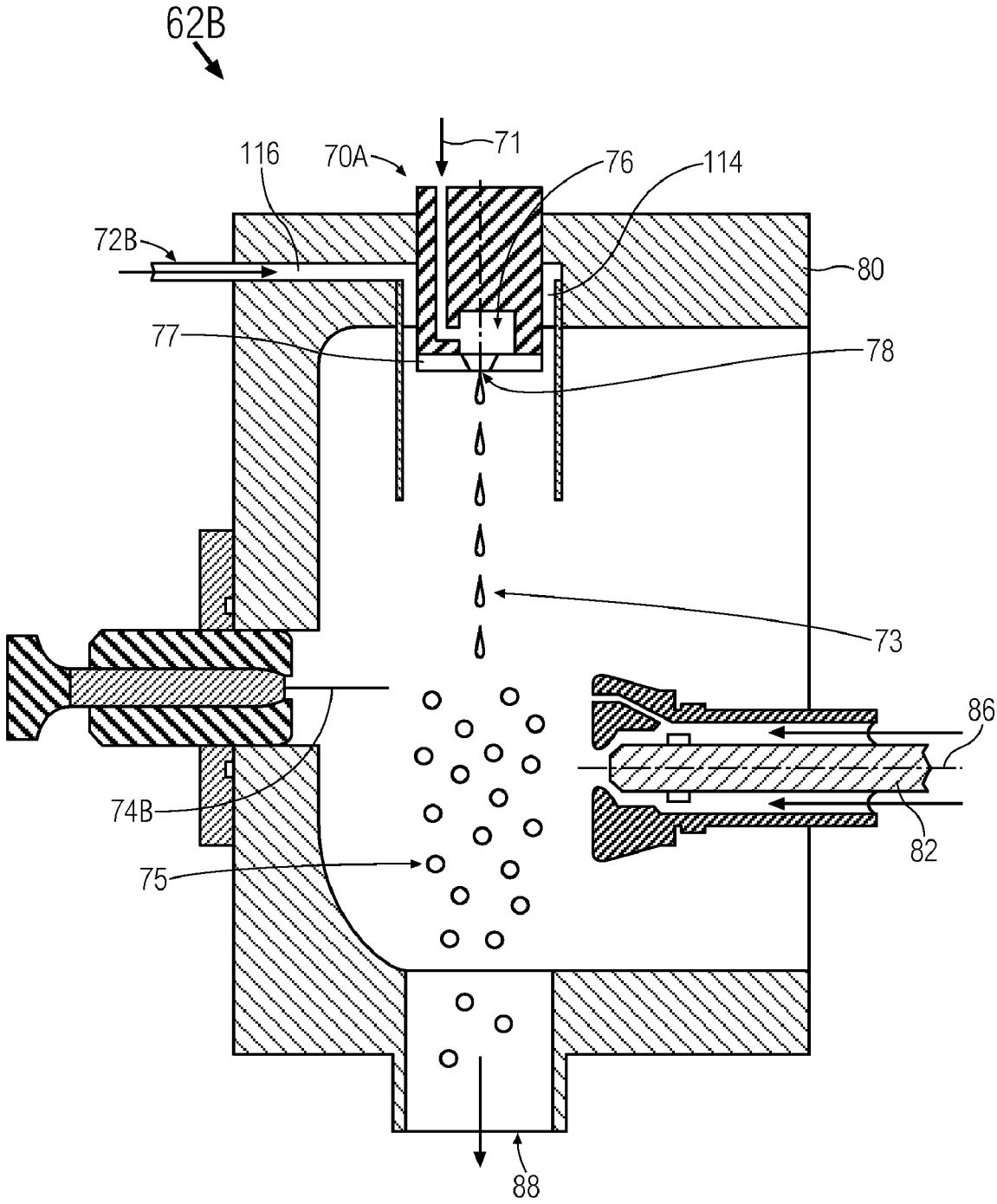
FIG. 7 is a cross-sectional view of an ion source according to another embodiment of the invention.

FIG. 7 shows a second ion source 62B according to another embodiment of the invention. This second ion source 62B includes the thermal liquid jetting device 70A as the spraying device 70, a gas source 72B as the dryer 72, and a corona needle 74B as the ionizer 74 all enclosed in a housing 80. As described above, the thermal liquid jetting device 70A has a firing chamber 76 flanked on one side by an orifice plate 77 having at least one orifice 78. The spraying device 70 may alternatively be a piezoelectric liquid jetting device. The gas source 72B provides a carrier gas to the uncharged aerosol 73 produced and discharged from the orifice 78. The carrier gas may be heated and applied directly or indirectly to the drying region. The carrier gas may be nitrogen, argon, xenon, carbon dioxide, air, helium, etc. The gas is preferable chemically inert but need not be inert for some applications and should be capable of carrying a sufficient amount of energy or heat. Other gases well known in the art that have these characteristic properties may also be used. A carrier gas conduit 114 may be used to provide the carrier gas directly to the drying region. The carrier gas conduit 114 may be attached or integrated with housing 80 as shown in FIG. 7. When the carrier gas conduit 114 is attached to the housing 10, a separate housing bore 116 may be employed to direct the carrier gas from the gas source 72B toward the carrier gas conduit 114. The carrier gas conduit 114 may partially or totally enclose the orifice plate 77 in such a way as to deliver the carrier gas to the aerosol 73 as it is produced from the orifice 78. The carrier gas flowed parallel and concentric to the aerosol 73 has a force vector that can keep the aerosol 73 in a confined space. Alternatively, the carrier gas may be flowed perpendicular to the aerosol 73. The carrier gas guides the aerosol towards an ionization region within the housing 80 of the ion source 62B, drying the aerosol 73 in the process to produce gas phase solvent and gas phase analyte 75. Again, the aerosol 73 is not subject to any electric field at the orifice 78 and is therefore uncharged or nonionized.

The corona needle 74B is disposed in the housing 80 downstream from the orifice plate 77. The voltage at the corona needle 74B is selected to produce ions that ionize the gas phase solvent and gas phase analyte 75. In other words, the electric field due to a high potential on the corona needle 14 causes a corona discharge that causes the gas phase solvent to be ionized and the analyte 75 to be eventually ionized. For positive ions, a positive corona is used, wherein the ions leaving the corona needle 74B are positively charged. For negative ions, a negative corona is used, with the ions leaving the corona needle 74B having a negative charge.

Although the present invention is described as implemented in the above described embodiments, it is not to be construed to be limited as such. For example, the dryer and ionizer in FIGS. 6 and 7 are interchangeable. In fact, any dryer or ionizer known in the art may be used in an ion source according to the invention. The ionizer can therefore be an atmospheric pressure photo-ionization (APPI) source or an atmospheric pressure chemical ionization (APCI) source.

As another example, different gases may be used in the ion source. An embodiment may include various points of introduction of a sweep gas and a drying gas. The gases may be combined to dry the aerosol. The gases may be introduced into the ion source by means of a single gas conduit. Alternatively, the sweep gas and drying gas may have different or separate points of introduction. Alternative points of gas introduction may provide for increased flexibility to maintain or alter gas/components and temperatures.

As yet another example, the ion source including the method of ionizing an analyte may be part of a multimode ion source.

What is claimed is:

1. A method of obtaining ions of an analyte comprising:

aerosolizing a sample using one of a thermal liquid jetting device and a piezoelectric liquid jetting device to obtain an aerosol without ionizing the sample, the sample comprising the analyte in a solvent;

drying the aerosol to obtain gas phase solvent and gas phase analyte; and ionizing the gas phase analyte to obtain ions thereof;

wherein the gas phase analyte is substantially ionized without substantially ionizing the gas phase solvent.

2. A method according to claim 1, further comprising guiding the aerosol in a desired direction with a carrier gas.

3. A method according to claim 1, wherein drying the aerosol to obtain gas phase solvent and gas phase analyte comprises drying the aerosol in a drying tube.

4. A method according to claim 3, wherein drying the aerosol in a drying tube comprises drying the aerosol in a heated drying tube.

5. A method according to claim 1, wherein ionizing the gas phase analyte to obtain ions thereof comprises irradiating the gas phase solvent and the gas phase analyte with light from a light source.

6. A method according to claim 5, wherein irradiating the gas phase solvent and the gas phase analyte with light from a light source comprises irradiating the gas phase solvent and gas phase analyte with light from one of a Krypton and an Argon gas light source.

7. A method according to claim 5, wherein irradiating the gas phase solvent and the gas phase analyte with light from a light source comprises irradiating the gas phase solvent and the gas phase analyte with light from a light source having a wavelength that at least substantially ionizes the gas phase analyte without substantially ionizing the gas phase solvent.

8. A method according to claim 1, wherein ionizing the gas phase analyte to obtain ions thereof comprises ionizing the gas phase analyte at non-atmospheric pressure to obtain ions thereof.

9. An ion source for obtaining ions of an analyte comprising:

one of a thermal liquid jetting device and a piezoelectric liquid jetting device that aerosolizes a sample to obtain an aerosol without ionizing the sample, the sample comprising the analyte in a solvent;

a dryer that dries the aerosol to obtain gas phase solvent and gas phase analyte; and an ionizer that ionizes the gas phase analyte to obtain ions thereof;

wherein the gas phase analyte is substantially ionized without substantially ionizing the gas phase solvent.

10. An ion source according to claim 9, wherein the dryer comprises a drying tube.

11. An ion source according to claim 10, wherein the drying tube comprises an inlet that receives a carrier gas.

12. An ion source according to claim 10, further comprising a heater that heats the drying tube.

13. An ion source according to claim 9, wherein ionizer comprises a light source that generates a light on the gas phase solvent and the gas phase analyte to obtain analyte ions.

14. An ion source according to claim 13, wherein the light source comprises one of a Krypton and an Argon gas light source.

15. An ion source according to claim 13, wherein the light source comprises a light source that emits light having a wavelength that at least substantially ionizes the gas phase analyte without substantially ionizing the gas phase solvent.

16. An ion source according to claim 9, wherein the ionizer that ionizes the gas phase analyte to obtain ions thereof comprises an ionizer that ionizes the gas phase analyte at non-atmospheric pressure to obtain ions thereof.

17. A mass spectrometer according to claim 16, wherein the ionizer comprises a light source that emits light that at least substantially ionizes the gas phase analyte without substantially ionizing the gas phase solvent.

18. A mass spectrometer including an ion source for obtaining ions of an analyte, the ion source comprising:

one of a thermal liquid jetting device and a piezoelectric liquid jetting device that aerosolizes a sample to obtain an aerosol without ionizing the sample, the sample comprising the analyte in a solvent;

a dryer that dries the aerosol to obtain gas phase solvent and gas phase analyte; and an ionizer that ionizes the gas phase analyte to obtain ions thereof;

wherein the gas phase analyte is substantially ionized without substantially ionizing the gas phase solvent.

19. A mass spectrometer according to claim 18, wherein the ionizer that ionizes the gas phase analyte to obtain ions thereof comprises an ionizer that ionizes the gas phase analyte at non-atmospheric pressure to obtain ions thereof.

* * * * *

UNITED STATES PATENT AND TRADEMARK OFFICE

CERTIFICATE OF CORRECTION

PATENT NO. : 7,855,358 B2
APPLICATION NO. : 11/963843
DATED : December 21, 2010
INVENTOR(S) : Arthur Schleifer et al.

It is certified that error appears in the above-identified patent and that said Letters Patent is hereby corrected as shown below:

In column 8, line 25, in Claim 17, delete "A mass spectrometer according to claim 16," and insert -- An ion source according to claim 16, --, therefor.

Signed and Sealed this
Seventeenth Day of July, 2012

David J. Kappos

David J. Kappos
*Director of the United States Patent and Trademark Office*